US005901881A

United States Patent [19]

Wang

[11] Patent Number: 5,901,881

[45] Date of Patent: May 11, 1999

[54] MULTIPURPOSE GLUE GUN

[75] Inventor: Chin-Fu Wang, Taipei, Taiwan

[73] Assignee: Chen Chu Li Su, Taipei County, Taiwan

[21] Appl. No.: 09/022,215

[22] Filed: Feb. 12, 1998

[51] Int. Cl.[6] ..... B65D 5/66

[52] U.S. Cl. ..... 222/113; 222/146.2; 126/401

[58] Field of Search ..... 222/146.2, 113; 126/401

[56] References Cited

U.S. PATENT DOCUMENTS 4,755,073 7/1988 Girardin et al. ..... 222/113

4,949,881 8/1990 Watanabe et al. ..... 222/113

5,479,914 1/1996 Tsai ..... 222/146.2

*Primary Examiner*—Phillippe Derakshani

*Attorney, Agent, or Firm*—Rosenberg, Klein & Bilker

[57] ABSTRACT

A glue gun which includes a housing, a barrel slidably mounted in the front side of the housing, the barrel defining a heating chamber and a fusion chamber above the heating chamber, one-way clamp provided inside the housing to hold a glue stick, permitting the glue stick to be fed into the fusion chamber, a igniter and gas burner unit mounted in the housing and controlled by an ignition control switch to burn fuel gas in the heating chamber, the igniter and gas burner unit having a metal screw tube for holding a soldering tip in front of a flame nozzle thereof.

4 Claims, 8 Drawing Sheets

MULTIPURPOSE GLUE GUN

BACKGROUND OF THE INVENTION

The present invention relates to a glue gun, and more particularly to a multipurpose glue gun which comprises an igniter and gas burner unit controlled to melt a glue stick for sealing. The igniter and gas burner unit has a metal screw tube for holding a soldering tip in front of a flame nozzle thereof for soldering.

A variety of glue guns have been disclosed, and have appeared on the market. These glue guns are commonly complicated and expensive. Before use, fuel gas must be filled in a gas chamber inside the housing. If storage fuel gas is used up, the gas chamber must be filled up with fuel gas again. Further, these glue guns cannot be used as a soldering gun.

SUMMARY OF THE INVENTION

The present invention has been accomplished to provide a glue gun which eliminates the aforesaid drawbacks. It is one object of the present invention to provide a multipurpose glue gun which can be used as a glue gun as well as a soldering gun. It is another object of the present invention to provide a multipurpose glue gun which uses disposable cigarette lighter as a heat source. It is still another object of the present invention to provide a multipurpose glue gun which is inexpensive to manufacture. According to one embodiment of the present invention, the A glue gun comprises a housing having a switch opening, two longitudinal sliding tracks bilaterally disposed on the inside, and a chuck holder spaced behind the sliding tracks; an igniter and gas burner unit mounted inside the housing and holding a disposable cigarette lighter and controlled to produce a flame at a flame nozzle thereof; a metal barrel mounted in the housing and moved along the sliding tracks, the metal barrel comprising a heating chamber which receives the flame nozzle of the igniter and gas burner unit, a fusion chamber above the heating chamber, and two wings raised from two opposite sides of the fusion chamber and supported on the sliding tracks; an one-way chuck mounted in the chuck holder inside the housing behind the barrel, the one-way chuck having a plurality of clamping strips; an one-way clamp mounted inside the housing in front of the chuck, the one-way clamp comprising a plurality of clamping strips; a silicon rubber seal ring mounted in an entrance at the fusion chamber of the barrel; an one-way annular binder mounted in the entrance at the fusion chamber behind the silicon rubber seal ring, the one-way annular binder comprising a plurality of clamping strips on the inside; a spring mounted around the barrel and stopped between the wings of the barrel and the chuck holder, the spring imparting a forward pressure to the barrel; a glue stick inserted through the one-way chuck, the one-way clamp and the one-way annular binder into the fusion chamber, and retained in place by the clamping strips of the one-way chuck and the clamping strips of the one-way clamp and the clamping strips of the one-way annular binder, the glue stick being allowed to be moved forwards through the one-way chuck, the one-way clamp and the one-way annular binder into the fusion chamber, and prohibited from backward movement by the clamping strips of the one-way chuck, the one-way clamp and the one-way annular binder.

DETAILED DESCRIPTION OF THE PREFERRED EMBODIMENT

Figure 1:
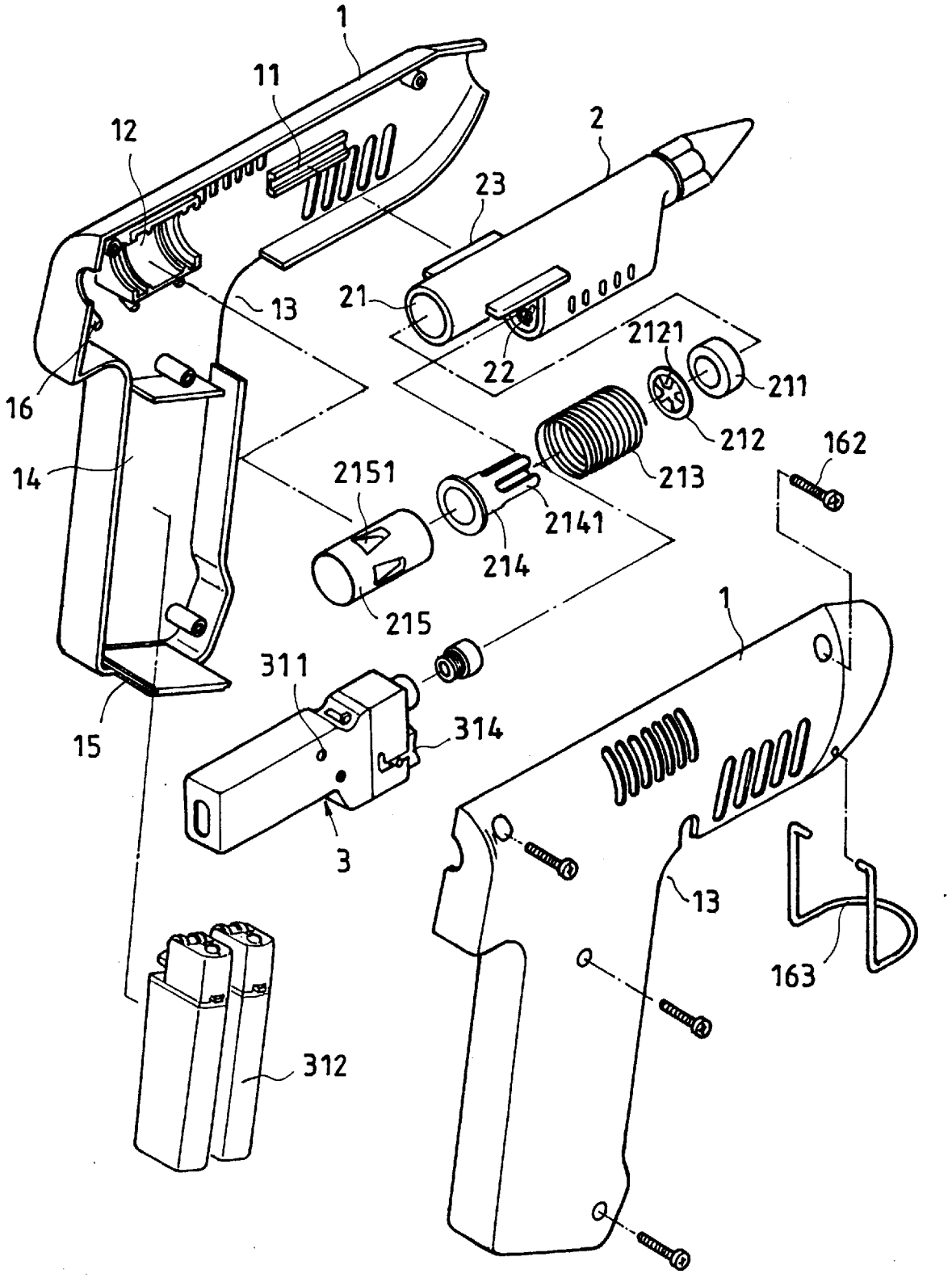
FIG. 1 is an exploded view of a glue gun according to one embodiment of the present invention.
Figure 2:
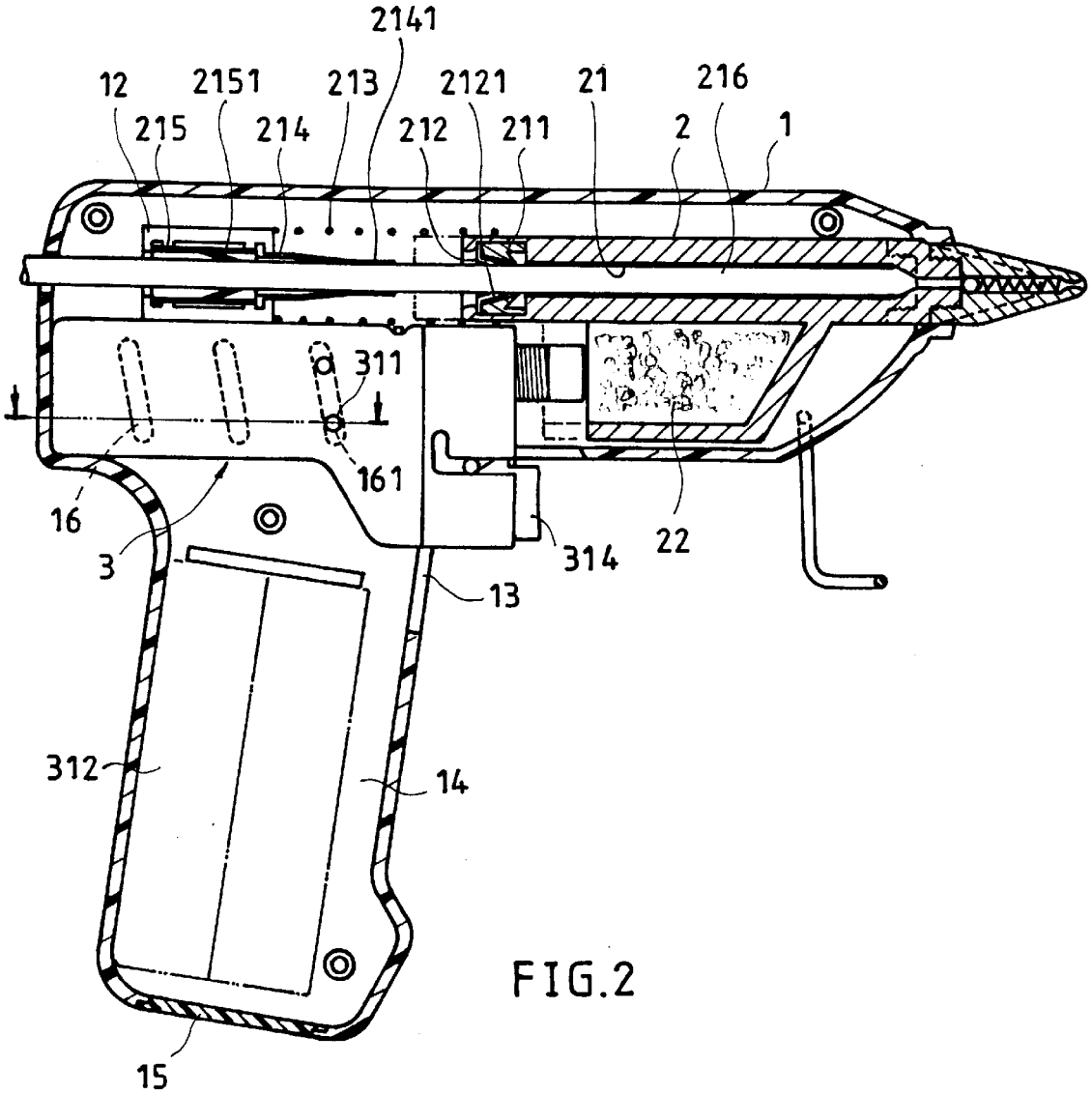
FIG. 2 is a sectional assembly view of the glue gun shown in FIG. 1.
Figure 2A:
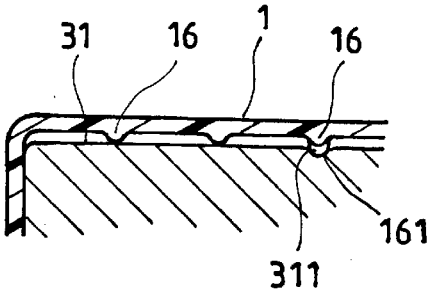
FIG. 2A is a sectional view in an enlarged scale of a part of the present invention, showing the engagement between the recessed portions at the igniter and the raised portions at the locating ribs.
Figure 3:
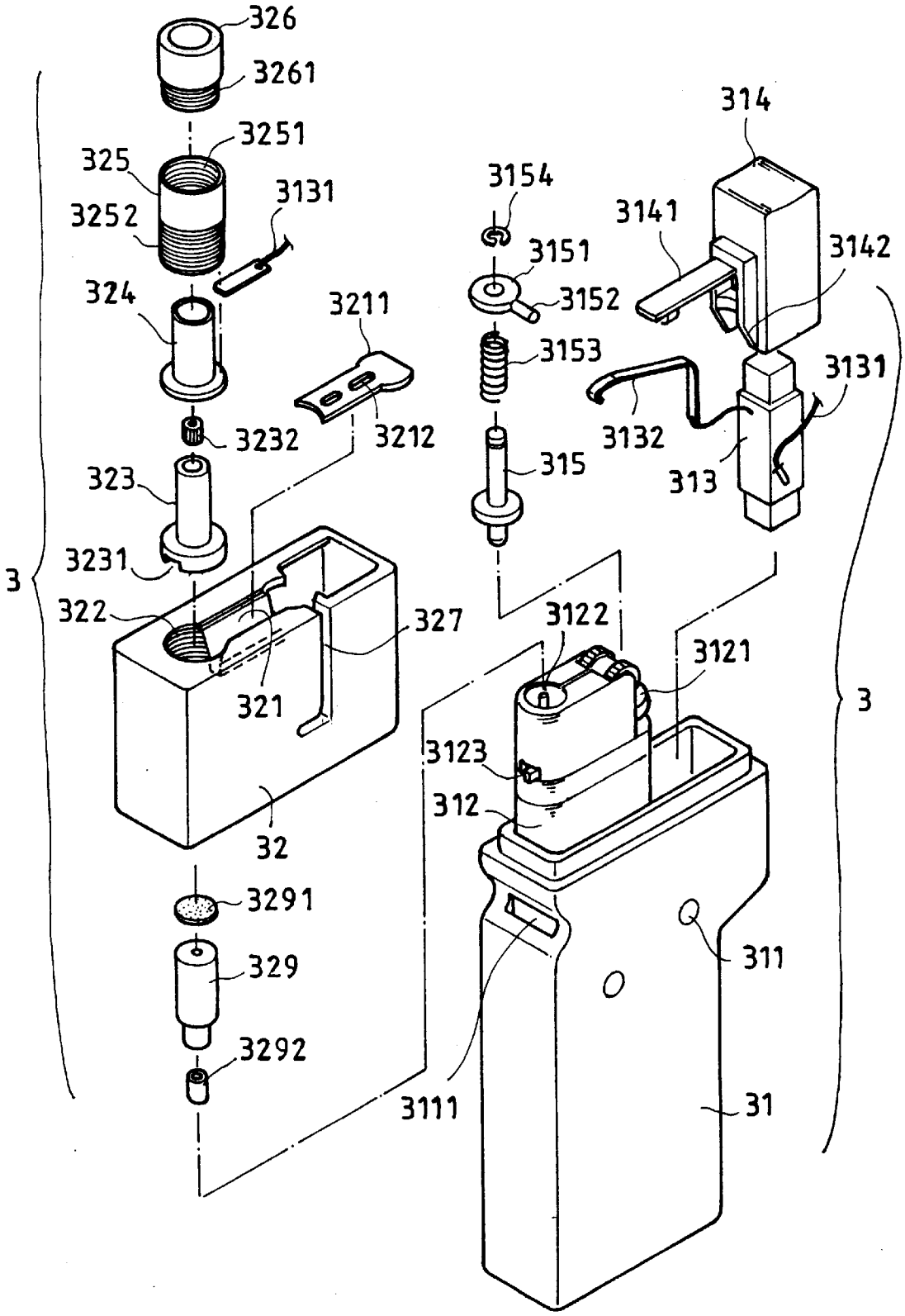
FIG. 3 is an exploded view of the igniter and gas burner unit according to the present invention.
Figure 3A:
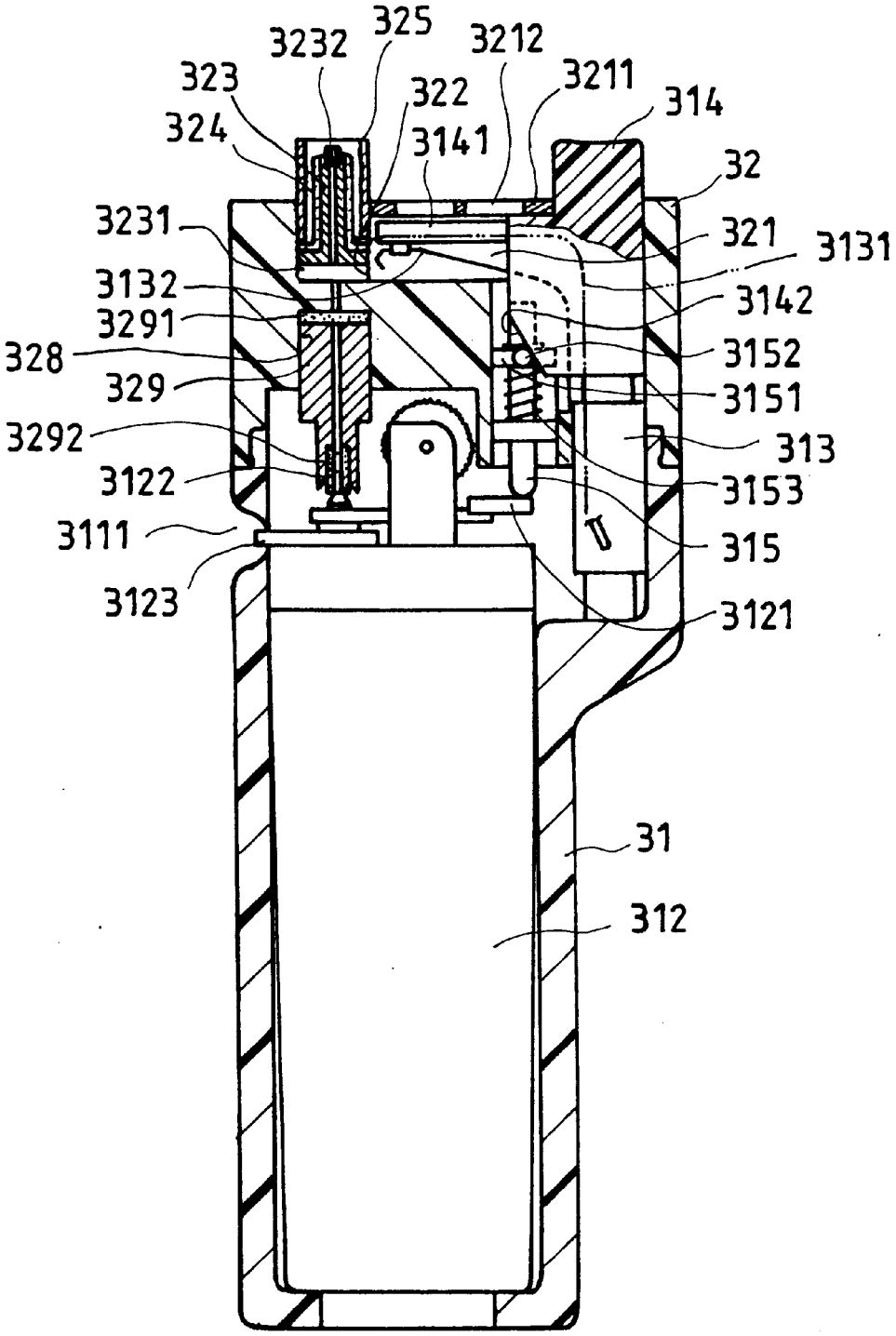
FIG. 3A is a sectional assembly view of the igniter and gas burner unit shown in FIG. 3.
Figure 3C:
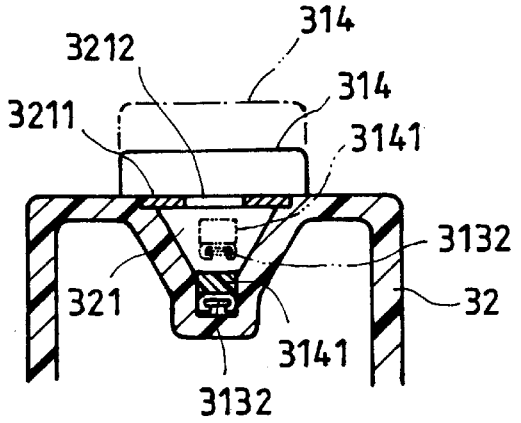
FIG. 3C is a partial view of the igniter and gas burner unit showing the projecting cover plate of the ignition control switch covered on the air holes on the top cover plate above the top cover according to the present invention.
Figure 3B:
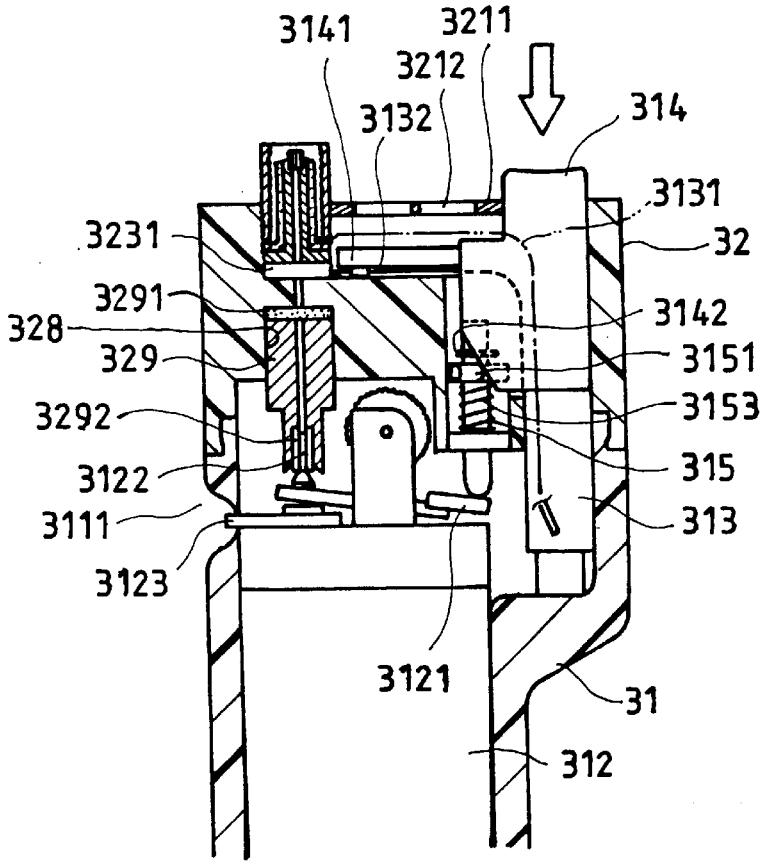
FIG. 3B is a partial view of the igniter and gas burner unit showing the ignition control switch depressed according to the present invention.

Referring to FIGS. 1, 2 and 2A, a housing 1 is shown having an opening 13. An igniter and gas burner unit 3 is mounted inside the housing 1, having disposable cigarette lighters 312 attached thereto. Fixed locating ribs 16 are provided inside the housing 1 to hold the igniter and gas burner unit 3 in place. The locating ribs 16 have raised portions 161. The igniter and gas burner unit 3 has a plurality of recessed portions 311 at two opposite sides respectively forced into engagement with the raised portions 161 at the locating ribs 16. The ignition control switch 314 of the igniter and gas burner unit 3 projects out of the opening 13. A metal barrel 2 is mounted in the housing 1 at its front side. The metal barrel 2 comprises a heating chamber 22 which receives the flame nozzle 3232 of the igniter and gas burner unit 3, a fusion chamber 21 above the heating chamber 22, and two wings 23 at two opposite sides of the fusion chamber 21. The wings 23 of the metal barrel 2 are slidably coupled to two sliding tracks 11 inside the housing 1. A one-way chuck 215 is mounted in a chuck holder 12 inside the housing 1 behind the barrel 2. The one-way chuck 215 comprises a plurality of clamping strips 2151. An one-way clamp 214 is mounted inside the housing 1 in front of the chuck 215. The one-way clamp 214 comprises a plurality of clamping strips 2141. A silicon rubber seal ring 211 is mounted in the entrance of the fusion chamber 21. An one-way annular binder 212 is mounted in the entrance of the fusion chamber 21 behind the silicon rubber seal ring 211. The one-way annular binder 212 comprises a plurality of clamping strips 2121 on the inside. A spring 213 is mounted around the rear end of the barrel 2 and stopped between the wings 23 and the chuck holder 12. The spring 213 imparts a forward pressure to the barrel 2. A glue stick 216 is inserted through the one-way chuck 215, the one-way clamp 214 and the one-way annular binder 212 into the fusion chamber 21. When the front end of the barrel 2 is pressed against the workpiece, the barrel 2 is moved backwards relative to the glue stick 216, thereby causing the front end of the glue stick 216 to be inserted deeply into the inside of the fusion chamber 21 and melted. When the barrel 2 is released from the workpiece, the barrel 2 is immediately pushed forwards to its former position by the spring 213, and at the same time the glue stick 216 is carried forwards by the one-way annular binder 212.

Referring to FIGS. 3, 3A, 3B and 3C, the igniter and gas burner unit 3 comprises a box 31, a top cover 32 covered on the top open side of the box 31. The box 31 holds a disposable cigarette lighter 312, an igniter 313, and an ignition control switch 314 above the igniter 313. The ignition control switch 314 comprises a projecting cover plate 3141 at one side. The projecting cover plate 3141 of the ignition control switch 314 extends to a conical mixing chamber 321 in the top cover 32. The top cover 32 has a top screw hole 322 at one side of the conical mixing chamber 321. A T-shaped metal gas tube 323 is mounted in the screw hole 322. The T-shaped metal gas tube 323 has a bottom notch 3231. A T-shaped heat insulative sleeve 324 is mounted on the T-shaped metal gas tube 323. A metal screw tube 325 is mounted around the T-shaped heat insulative sleeve 324 and connected to the negative terminal 3131 of the igniter 313, having an outer thread 3252 at the bottom threaded into the screw hole 322 on the top cover 32 and an inner thread 3251 at the top. An extension tube 326 is provided having an outer thread 3261 at one end threaded into the inner thread 3251 on the metal screw tube 325. The top cover 32 has a stepped bottom hole 328 disposed in communication with the screw hole 322. A gas filter 3291 is mounted in the stepped bottom hole 328. A connector 329 is connected between the gas filter 3291 and the gas nozzle 3122 of the disposable cigarette lighter 312. A rubber plug 3292 is mounted in the bottom end of the connector 329 around the gas nozzle 3122 of the disposable cigarette lighter 312 to prevent a gas leakage. A press rod 315 is connected between the ignition control switch 314 and the gas lever 3121 of the disposable cigarette lighter 312. A pressure member 3151 is secured to the press rod 315 by a clamp 3154. The pressure member 3151 has a handle 3152 raised from the periphery. A spring 3153 is mounted around the press rod 315, imparting an upward pressure to the pressure member 3151. When the ignition control switch 314 is depressed, the projecting cover plate 3141 is lowered with the ignition control switch 314 to close the conical gas chamber 321 in the top cover 32 and to stop air from entering the conical mixing chamber 321, and at the same time the positive terminal 3132 which is fastened to the projecting cover plate 3141 is moved into contact with the T-shaped metal gas tube 323, thereby causing sparks to be produced between the metal screw tube 325 and the T-shaped metal gas tube 323. When the ignition switch 314 is lowered, the pressure member 3151 is forced downwards by bevel edges 3142 of the ignition switch 314, thereby causing the press rod 315 to be pressed on the gas lever 3121. Therefore, a flow of fuel gas flows out of the gas nozzle 3122 through the connector 329 and the T-shaped metal gas tube 323 into the flame nozzle 3232, and then burned at the flame nozzle 3232. When the pressure member 3151 is lowered, the handle 3152 is moved along L-shaped slot 327 on the top cover 32 to the bottom and then forced by the bevel edges 3142 of the ignition control switch 313 into engagement with the horizontal bottom section of the L-shaped slot 327, and therefore the gas lever 3121 is retained in the "on" position. When the ignition control switch 314 is released after ignition, the projecting cover plate 3141 is lifted with the ignition control switch 314 from the conical mixing chamber 321, permitting air to pass through air holes 3212 on a top cover plate 3211 into the conical mixing chamber 321, and then to enter the bottom notch 3231 on the T-shaped metal gas tube 323 for mixing with fuel gas for combustion. When the handle 3152 is moved away from the horizontal bottom section of the L-shaped slot 327 into the vertical top section of the L-shaped slot 327, the pressure member 3151 is immediately pushed upwards to its former position by the spring 3153, and therefore the gas lever 3121 is released, and the gas nozzle 3122 is closed again. The box 31 of the igniter and gas burner unit 3 has a hole 3111 through which the flame adjustment lever 3123 extends to the outside for operation by hand.

Figure 4:
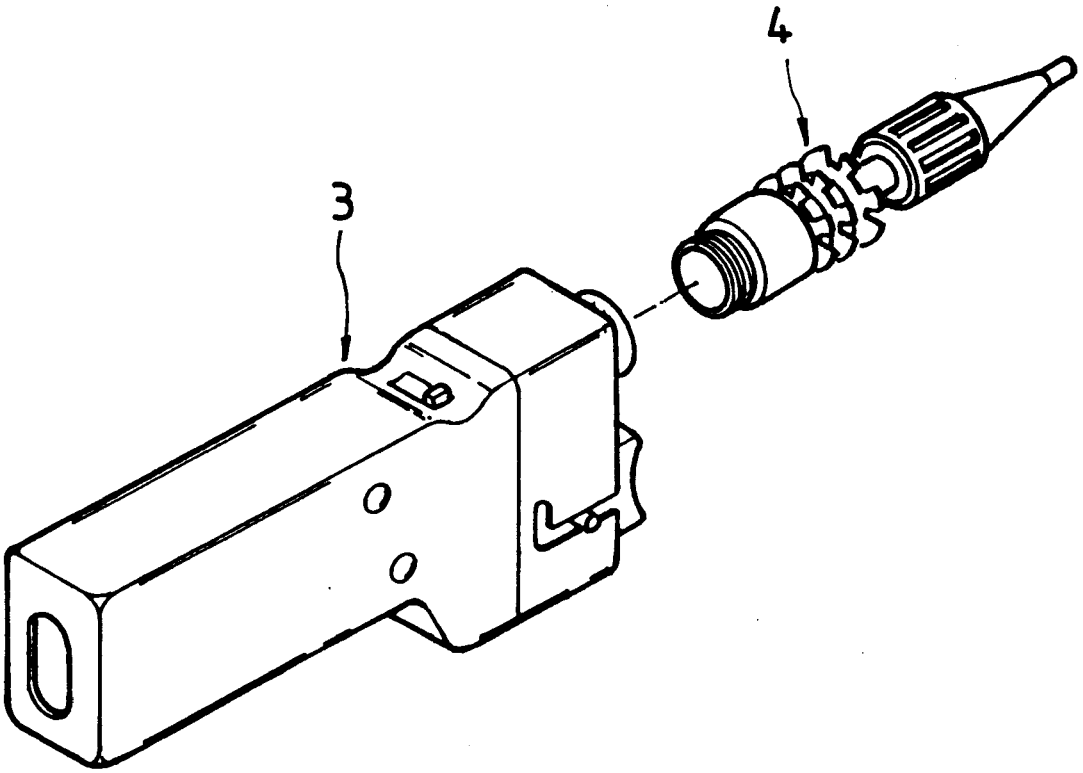
FIG. 4 shows the positioning of a soldering tip on the igniter and gas burner unit according to the present invention.

Referring to FIG. 4 and FIG. 3 again, the extension tube 326 may be disconnected from the metal screw tube 325, and a soldering tip 4 may be attached to the metal screw tube 325 instead of the extension tube 326.

Figure 5:
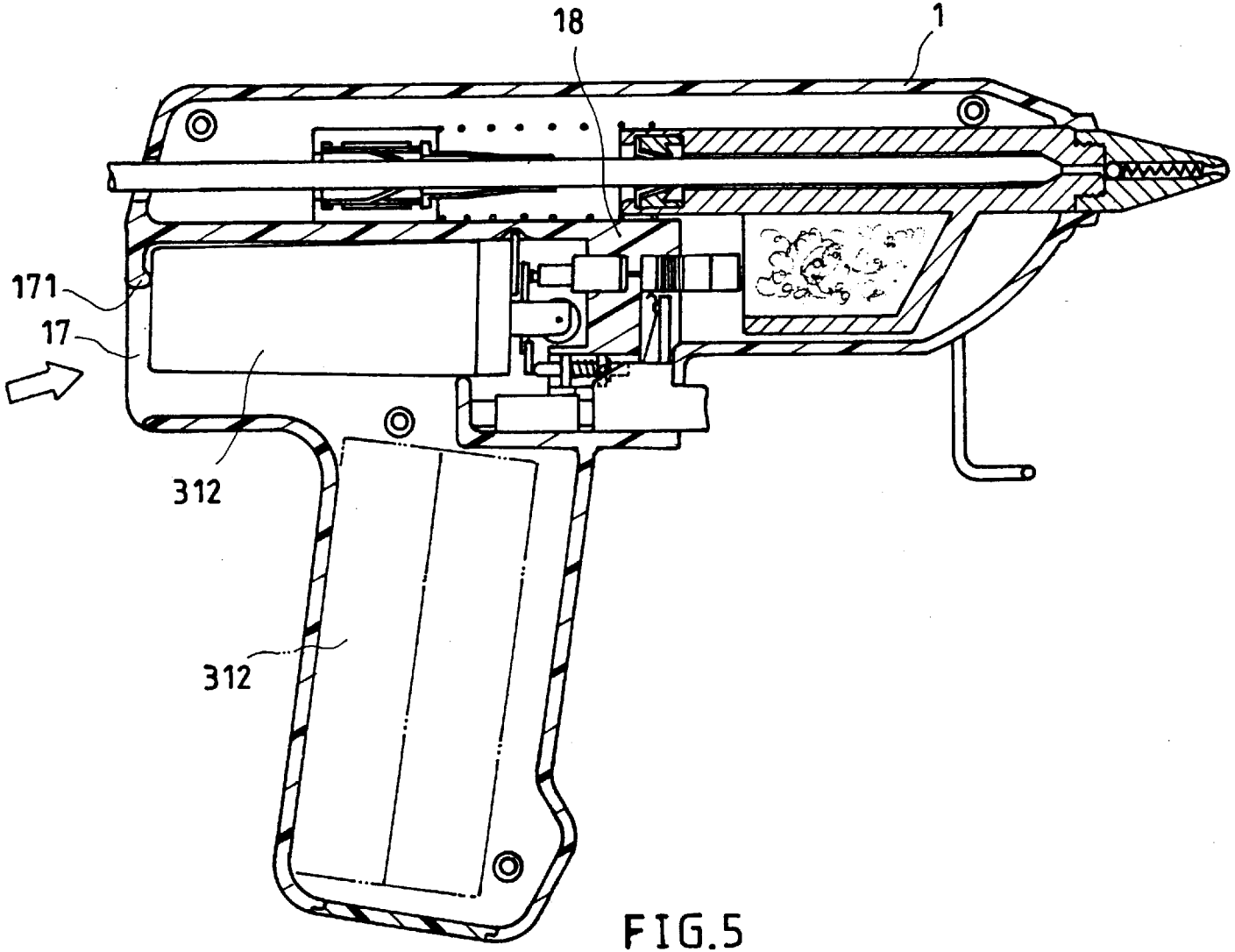
FIG. 5 is a sectional view of a glue gun according to a second embodiment of the present invention.

FIG. 5 shows a glue gun according to a second embodiment of the present invention. According to this embodiment, frame boards 18 are provided inside the housing 1 defining a conical mixing chamber 181 and a space for holding the ignition control switch 314, the igniter 313, the press rod 315, the pressure member 3151, the T-shaped metal gas tube 323, the flame nozzle 3232, the T-shaped heat insulative sleeve 324, the metal screw tube 325, the gas filter 3291, the connector 329 and the rubber plug 3292 of the igniter and gas burner unit 3. A back hole 17 is provided at the back side of the housing 1 through which a disposable cigarette lighter 312 is inserted into the housing 1. A retainer flange 171 is provided at the back hole 17 for securing the installed disposable cigarette lighter 312 in place.

Figure 6:
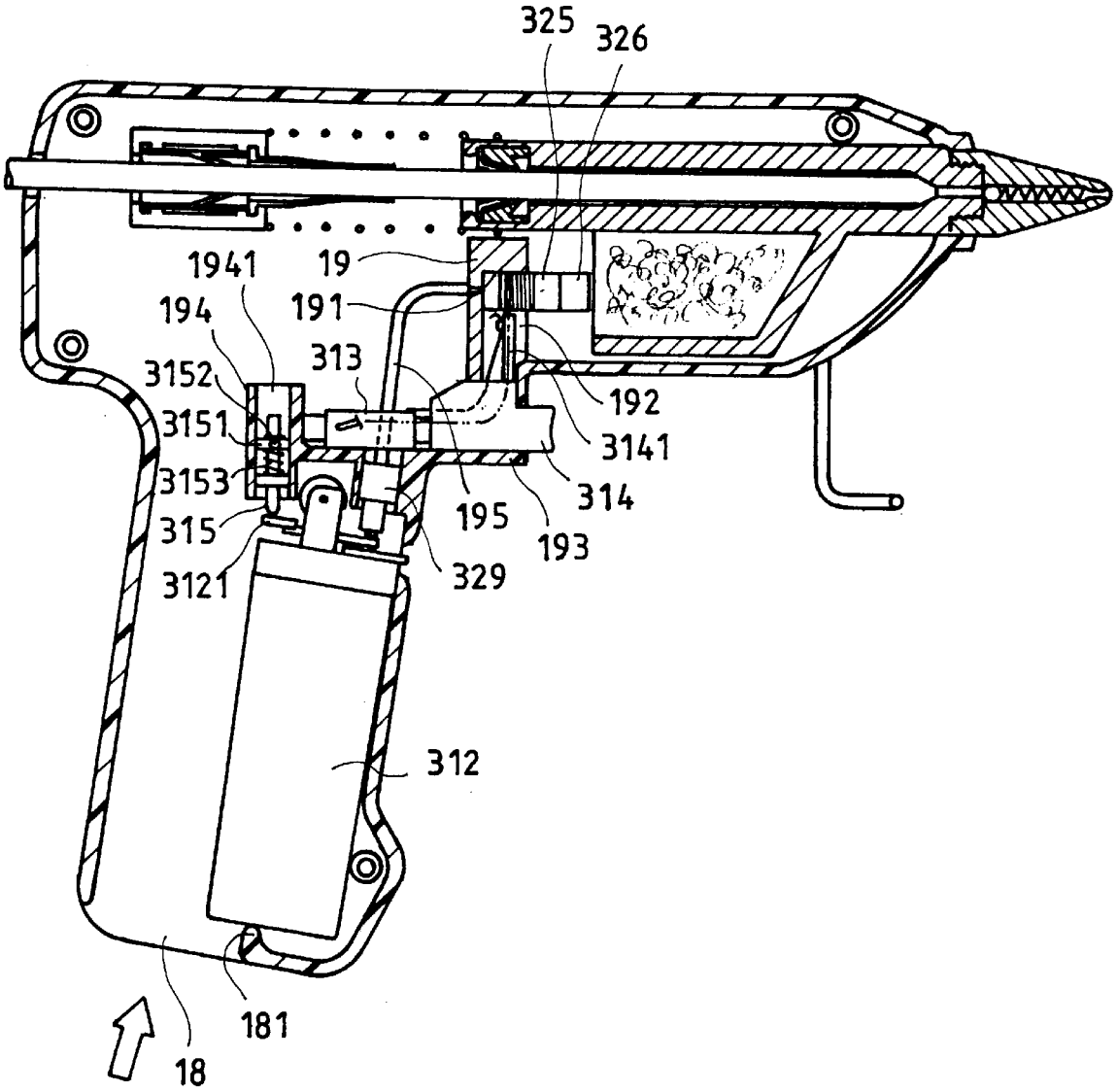
FIG. 6 is a sectional view of a glue gun according to a third embodiment of the present invention.

FIG. 6 shows a glue gun according to a third embodiment of the present invention. According to this embodiment, a holder 19 is provided inside the housing 1. The holder 19 comprises a conical mixing chamber 192, and a screw hole 191 at one side of the conical mixing chamber 192. The T-shaped metal gas tube 323, the flame nozzle 3232, the T-shaped heat insulative sleeve 324 and the metal screw tube 325 of the igniter and gas burner unit 3 are installed in the screw hole 191 on the holder 19. A transverse mounting board 193 is provided inside the housing 1 to hold the igniter 313 and the ignition control switch 314, permitting the projecting cover plate 3141 to be extended to the conical mixing chamber 192 in the holder 19, and the ignition control switch 314 to be extended out of a hole (not shown) on the housing 1 for operation by hand. The gas filter 3291 and the connector 329 are mounted in the transverse mounting board 193 on the middle. A guide tube 195 is connected between the screw hole 191 on the holder 19 and the connector 329 for guiding fuel gas into the conical mixing chamber 192. A frame 194 is provided inside the housing 1 behind the transverse mounting board 193. The frame 194 defines a vertical sliding hole 1941, which holds the press rod 315, the pressure member 3151 and the spring 3153. The handle 3152 of the pressure member 3151 is inserted through a L-shaped slot (not shown) on the housing 1 for operation by hand. A bottom hole 18 is provided at the bottom side of the housing 1. Through the bottom hole 18, a disposable cigarette lighter 312 is inserted into the housing 1. A retainer flange 181 is provided at the bottom hole 18 for securing the installed disposable cigarette lighter 312 in place.

It is to be understood that the drawings are designed for purposes of illustration only, and are not intended as a definition of the limits and scope of the invention disclosed.

What the invention claimed is:

1. A glue gun comprising:

a housing having a switch opening, two longitudinal sliding tracks bilaterally disposed on the inside, and a chuck holder spaced behind said sliding tracks;

an igniter and gas burner unit mounted inside said housing and holding a disposable cigarette lighter and controlled to produce a flame at a flame nozzle thereof;

a metal barrel mounted in said housing and moved along said sliding tracks, said metal barrel comprising a heating chamber which receives the flame nozzle of said igniter and gas burner unit, a fusion chamber above said heating chamber, and two wings raised from two opposite sides of said fusion chamber and supported on said sliding tracks;

an one-way chuck mounted in said chuck holder inside said housing behind said barrel, said one-way chuck having a plurality of clamping strips;

an one-way clamp mounted inside said housing in front of said chuck, said one-way clamp comprising a plurality of clamping strips;

a silicon rubber seal ring mounted in an entrance at said fusion chamber of said barrel;

an one-way annular binder mounted in the entrance at said fusion chamber behind said silicon rubber seal ring, said one-way annular binder comprising a plurality of clamping strips on the inside;

a spring mounted around said barrel and stopped between the wings of said barrel and said chuck holder, said spring imparting a forward pressure to said barrel;

a glue stick inserted through said one-way chuck, said one-way clamp and said one-way annular binder into said fusion chamber, and retained in place by the clamping strips of said one-way chuck and the clamping strips of said one-way clamp and the clamping strips of said one-way annular binder, said glue stick being allowed to be moved forwards through said one-way chuck, said one-way clamp and said one-way annular binder into said fusion chamber, and prohibited from backward movement by the clamping strips of said one-way chuck, said one-way clamp and said one-way annular binder.

2. The glue gun of claim 1, wherein said igniter and gas burner unit comprises:

a box mounted inside said housing, said box holding a disposable cigarette lighter having a gas lever, a gas nozzle and a flame adjustment lever;

a box cover covered on said box, said box cover comprising a conical mixing chamber, a plurality of air holes at a top side thereof disposed in communication with said conical mixing chamber, a top screw hole at a top side of said conical mixing chamber, a stepped bottom hole at a bottom side thereof disposed in communication with said screw hole, and a L-shaped slot at one lateral side thereof;

a T-shaped metal gas tube mounted in said screw hole on said box cover, said T-shaped metal gas tube having a bottom notch;

a T-shaped heat insulative sleeve mounted on said T-shaped metal gas tube;

a metal screw tube mounted around said T-shaped heat insulative sleeve, said metal screw tube having an outer thread at one end threaded into the screw hole on said box cover and an inner thread at an opposite end for mounting an extension tube or a soldering tip outside said housing;

a gas filter mounted in the stepped bottom hole on said box cover;

a connector connected between said gas filter in said stepped bottom hole on said box cover and the gas nozzle of said disposable cigarette lighter, said connector having a rubber plug mounted in a bottom end thereof and secured to the gas nozzle of said disposable cigarette lighter;

a igniter having a positive terminal, and a negative terminal connected to said metal screw tube, the positive terminal being moved into contact with said T-shaped metal gas tube causing sparks to be produced between said T-shaped metal gas tube and said metal screw tube;

an ignition control switch extended out of the opening on said housing and controlled to press said igniter and to force the positive terminal of said igniter into contact with said T-shaped metal gas tube, said ignition control switch having a projecting cover plate which closes the air holes on said box cover when said ignition control switch is depressed to trigger said igniter;

a press rod connected between said ignition control switch and the gas lever of said disposable cigarette lighter;

a pressure member secured to said press rod by a clamp, said pressure member having a handle raised from the periphery and inserted into the L-shaped slot on said box cover;

a spring mounted around said press rod, and imparting an upward pressure to said pressure member.

3. The glue gun of claim 2, wherein said housing comprises a plurality of frame boards defining a conical mixing chamber and a space for holding the ignition control switch, the igniter, the press rod, the pressure member, the T-shaped metal gas tube, the flame nozzle, the T-shaped heat insulative sleeve, the metal screw tube, the gas filter and the connector and the rubber plug of said igniter and gas burner unit, a back hole at a back side thereof through which said disposable cigarette lighter is inserted into said housing, and retainer flange at said back hole for securing said disposable cigarette lighter in place.

4. The glue gun of claim 2, wherein said housing comprises a holder on the inside defining a conical mixing chamber and a screw hole at one side of said conical mixing chamber to hold the T-shaped metal gas tube, the flame nozzle, the T-shaped heat insulative sleeve and the metal screw tube of said igniter and gas burner unit, a transverse mounting board which holds the igniter and the ignition control switch of said igniter and gas burner unit, permitting the projecting cover plate of said ignition switch to be extended to the conical mixing chamber in said holder, and the ignition control switch to be extended out of a hole on said housing for operation by hand, a guide tube connected between the screw hole on said holder and the connector of said igniter and gas burner unit for guiding fuel gas from said disposable cigarette lighter to said conical mixing chamber, a frame disposed behind said transverse mounting board and defining a vertical sliding hole, which holds the press rod, the pressure member and the spring of said igniter and gas burner unit, permitting the handle of said pressure member to be extended out of a L-shaped slot on said housing for operation by hand, a bottom hole at a bottom side thereof through which said disposable cigarette lighter is inserted, and a retainer flange at said bottom hole which secures said disposable cigarette lighter in place.

* * * * *